US007472845B2

(12) United States Patent
Mohamed et al.

(10) Patent No.: US 7,472,845 B2
(45) Date of Patent: Jan. 6, 2009

(54) ORIFICE DISC FOR FUEL INJECTOR

(75) Inventors: Abdel-Aleam Hefney Mohamed, Norfolk, VA (US); John J. Horsting, Williamsburg, VA (US); Scott Bruhwel, Newport News, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 0 days.

(21) Appl. No.: 11/373,473

(22) Filed: Mar. 10, 2006

(65) Prior Publication Data

US 2006/0202062 A1 Sep. 14, 2006

Related U.S. Application Data

(60) Provisional application No. 60/660,646, filed on Mar. 11, 2005.

(51) Int. Cl.
*F23D 11/36* (2006.01)

(52) U.S. Cl. ..... 239/543; 239/533.12; 239/556; 239/585.4; 239/596; 239/601; 239/900

(58) Field of Classification Search ..... 239/533.12, 239/585.1, 585.2, 585.3, 585.4, 585.5, 601, 239/596, 900, 533.2, 558, 559, 543–545, 239/556

See application file for complete search history.

(56) References Cited

U.S. PATENT DOCUMENTS 4,699,323 A * 10/1987 Rush et al. ..... 239/544
5,662,277 A * 9/1997 Taubitz et al. ..... 239/585.4
2004/0178286 A1 * 9/2004 Takeda et al. ..... 239/463

* cited by examiner

*Primary Examiner*—Christopher S Kim

(57) ABSTRACT

An orifice disc for a fuel injector includes two orifices that provide a desired interaction between two fuel flows to increase fuel atomization and improve combustion performance. The orifice disc includes a first orifice and a second orifice that are disposed at an interaction angle relative to each other. The orifices are orientated relative to each other such that fuel flow exiting the outlets impinges on each other to further reduce the size of fuel droplets. Large dramatic changes in momentum caused by the impingement of fuel flows disintegrates fuel droplets into much smaller finer fuel droplets that provided enhanced atomization.

7 Claims, 6 Drawing Sheets

ORIFICE DISC FOR FUEL INJECTOR

CROSS REFERENCE TO RELATED APPLICATION

The application claims priority to U.S. Provisional Application No. 60/660,646 which was filed on Mar. 11, 2005.

BACKGROUND OF THE INVENTION

This invention generally relates to an orifice plate for a fuel injector. More particularly, this invention relates to an orifice plate for improving atomization of fuel.

Fuel injectors meter fuel in predictable controlled quantities into an air stream to provide a desired air/fuel mixture that is drawn into a combustion chamber. Typically, fuel emitted from the fuel injector is atomized to encourage mixing with the air for combustion. Atomization of fuel is performed by including a number of orifices of a desired diameter to define the atomization of fuel.

One method of quantifying atomization of fuel is to measuring the droplet size generated through the orifices. A known value of determining a value indicative of droplet size is a Saunter Mean Diameter (SMD). The SMD measure accounts for differences in droplet size within the sample fuel spray. The smaller the SMD value the smaller droplets of fuel that are present, indicating an increased amount of atomization. Increased atomization with smaller fuel droplets improves combustion, which in turn improves performance and reduces undesired emissions.

Disadvantageously, smaller orifices sizes can be utilized to improve atomization, but also result in a reduced the fuel flow rate. The fuel flow rates must be at certain desired levels to provide the quantity of fuel required for combustion and to produce the desired performance. Further, smaller orifice sizes can also require higher than desired fuel pressure requirements to maintain the desired fuel flow rates. Additionally, smaller orifices are much more susceptible to clogging from contaminants present within the fuel.

Accordingly, it is desirable to design and develop a method and device for improving atomization without adversely affecting fuel flow rates, or increasing the susceptibility to contaminants.

SUMMARY OF THE INVENTION

An example orifice disc includes two orifices that provide a desired interaction between two fuel flows to increase fuel atomization and improve combustion performance.

An example fuel injector emits a metered spray of fuel through an orifice disc. The orifice disc shapes and atomizes the spray of fuel to include small droplets of fuel. The smaller the fuel droplet the better the air fuel mixture to provide corresponding improvements in combustion performance.

The example orifice disc includes a first orifice and a second orifice that are disposed at an interaction angle relative to each other. The orifices are orientated relative to each other such that fuel flow exiting the outlets impinges on each other to further reduce the size of fuel droplets. Fuel flow includes velocity components in an X and Y direction. The X component of the fuel flow velocity is reduced to approximately zero at the outlets and the Y component of the fuel flow velocity is increased. The large dramatic changes in momentum of the fuel droplets cause large changes in mass transfer rates that disintegrate the fuel droplets into much smaller finer fuel droplets to enhance atomization. The collisions are produced by aligning the orifices to direct fuel flow into each other at or before the fuel outlet surface.

Accordingly, the example fuel orifice discs create large changes in momentum to transform fuel flow into fine droplets. The angular orientation of the orifices provide for tailoring and targeting of the fuel spray as desired.

These and other features of the present invention can be best understood from the following specification and drawings, the following of which is a brief description.

DETAILED DESCRIPTION OF THE PREFERRED EMBODIMENT

Figure 1:
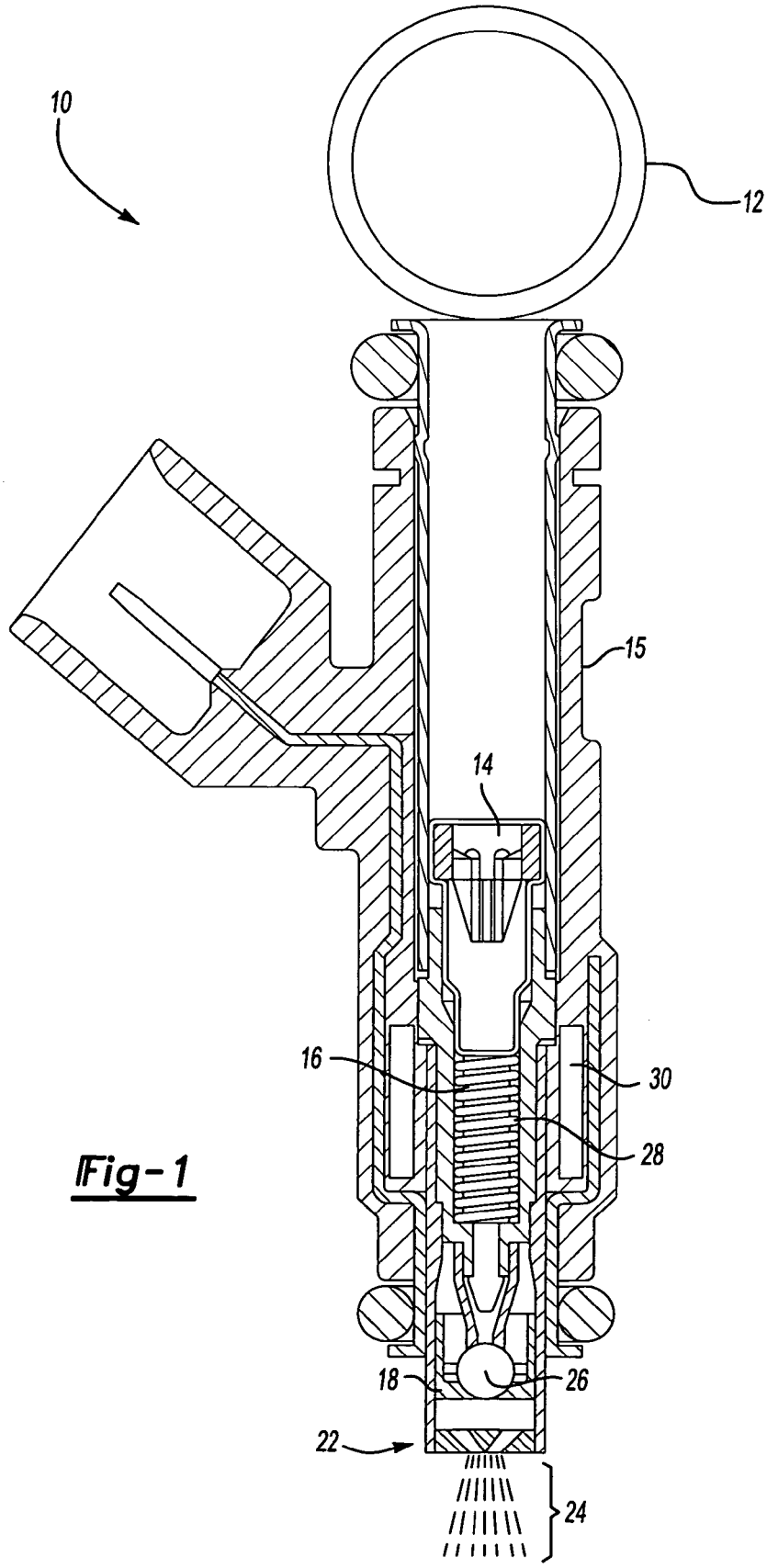
FIG. 1 is a cross-sectional view of an example fuel injector.

Referring to FIG. 1, an example fuel injector assembly 10 includes a fuel injector 15 that emits a metered spray of fuel 24. The fuel injector 15 includes an orifice disc 22 that shapes and atomizes the spray of fuel 24. The fuel injector 15 includes an armature 16 that selectively lifts a valve ball 26 from a seat 18 to provide for the flow of fuel from the fuel injector 15. The armature 16 is biased toward a position closing the valve ball 26 by a spring 28. The operation of the fuel injector 15 is exemplary and other fuel injector configurations will benefit from the disclosures of this invention.

The fuel spray 24 emitted from the fuel injector 15 through the orifice disc 22 is atomized to include small droplets of fuel. The smaller the fuel droplet, the better the air fuel mixture, resulting in improved combustion performance. Fuel droplets are measured according to a measure known as the Saunter Mean Diameter (SMD). The SMD provides a measure of fuel droplet diameter as a volume to surface area ratio for the entire spray. The SMD measurement weights any data in a manner that ensures that larger particles increase the SMD value while many smaller droplets are required to decrease the SMD value. Accordingly, reducing the SMD value results in an overall decrease in fuel droplet size that is indicative of improved atomization.

Figure 2:
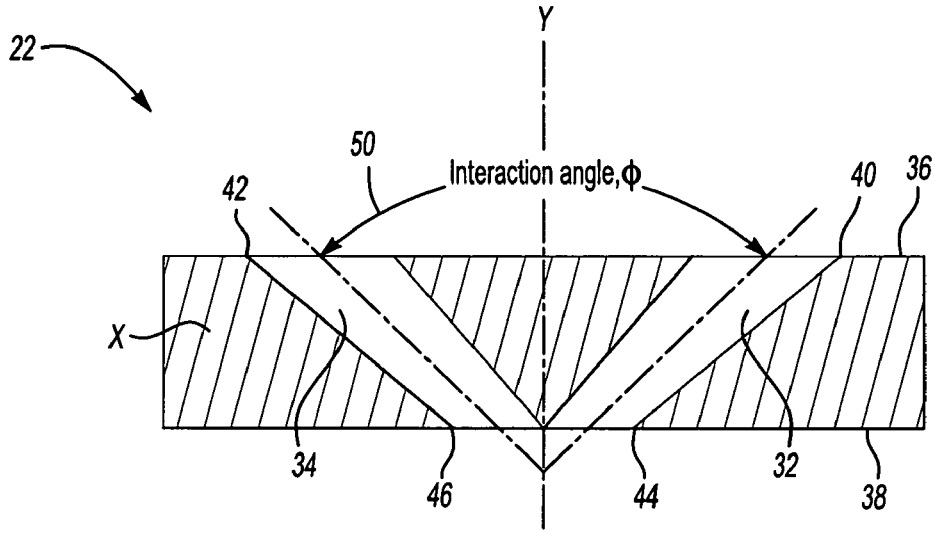
FIG. 2 is a cross-sectional view of an example orifice disc.
Figure 3:
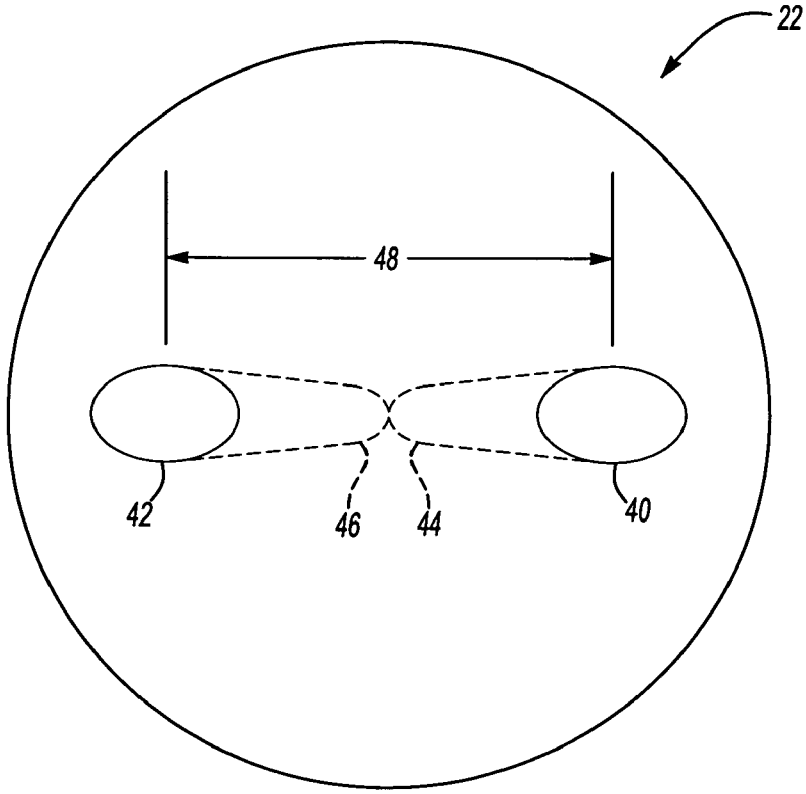
FIG. 3 is a top view of an example orifice disc.

Referring to FIGS. 2 and 3, the orifice disc 22 includes a first orifice 32 and a second orifice 34 that are disposed at an interaction angle 50 relative to each other. The first orifice 32 includes a first inlet 40, and the second orifice includes a second inlet 42 that is spaced a distance 48 from the first inlet 40. The first orifice 32 includes a first outlet 44 that is disposed substantially adjacent a second outlet 46. The orifices 32, 34 are orientated relative to each other such that fuel flow exiting the outlets 44, 46 impinges on each other to reduce the size of fuel droplets.

As appreciated, FIGS. 2 and 3 illustrate one set of example orifices 32, 34. The orifice disc 22 will include many orifices sets to provide the desired fuel flow rates desired for operation of the fuel injector 15. The number and orientation of the fuel orifice sets are orientated within the fuel disc 22 not only to provide the desired fuel flow, but also to target fuel flow as is desired to improve and tailor combustion performance.

Fuel flow includes velocity components in an X and Y direction. The X component of the fuel flow velocity is reduced to approximately zero at the outlets 44, 46, and the Y component of the fuel flow velocity is increased. The large dramatic changes in momentum of the fuel droplets comprising the fuel flow cause large changes in a mass transfer rate that disintegrate the fuel droplets into much smaller finer fuel droplets that enhance atomization. Further, the collisions produced by aligning the orifices 32, 34 to direct fuel flow into each other at or before the fuel outlet surface 38 reduce fuel droplet size. The first orifice 32 and the second orifice 34 are aligned such that the first fuel flow and the second fuel flow impinge on each other at some point between the fuel inlet surface 36 and the fuel outlet surface 38.

The first fuel flow and the second fuel flow may also impinge on each other at the fuel outlet surface 38 or very close the outlet surface. The fuel flows can impinge on each other at a distance equal to or less than 100 um from the fuel outlet surface 38 and provide the desired reduction in SMD value.

The orifices 32, 34 are tapered in a converging manner beginning with larger inlets 40, 42 that taper to corresponding smaller outlets 44, 46. The tapered orifices 32, 34 provide an increase in velocity that in turn aids in increasing the disintegration of fuel droplets into smaller sizes as is indicated by reduced SMD values. Increases in the fuel flow velocity through the orifices 32, 34, produce larger changes in momentum that in turn produce the desired improvements to fuel atomization.

The droplet size is decreased responsive to the interaction angle 50. Larger interaction angles 50 of approximately 90°, as is illustrated, decrease SMD values to approximately 50 um. The impingement of fuel flows occurs substantially at or before the fuel outlet surface 38. This positioning of impingement is provided by the outlets 44, 46 being disposed substantially adjacent each other.

Figure 4A:
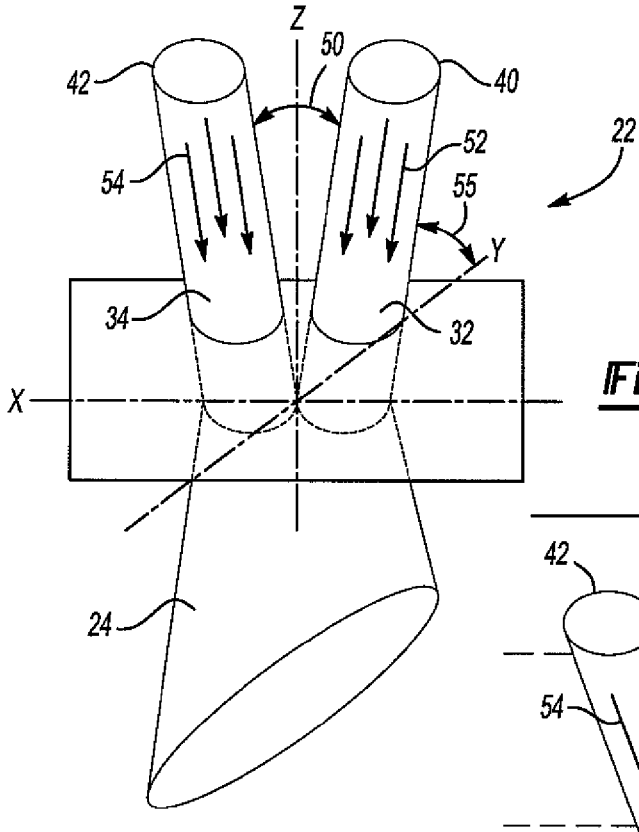
FIG. 4A is a schematic view of example fuel flow through the orifice disc.

Referring to FIG. 4A, a schematic view of the orifice disc 22 and a first fuel flow 52 and a second fuel flow 54 illustrate the interaction of the fuel flows that result in the fuel spray 24. The first orifice 32 and the second orifice 34 provide for the formation of an elliptical spray pattern 24.

Figure 4B:
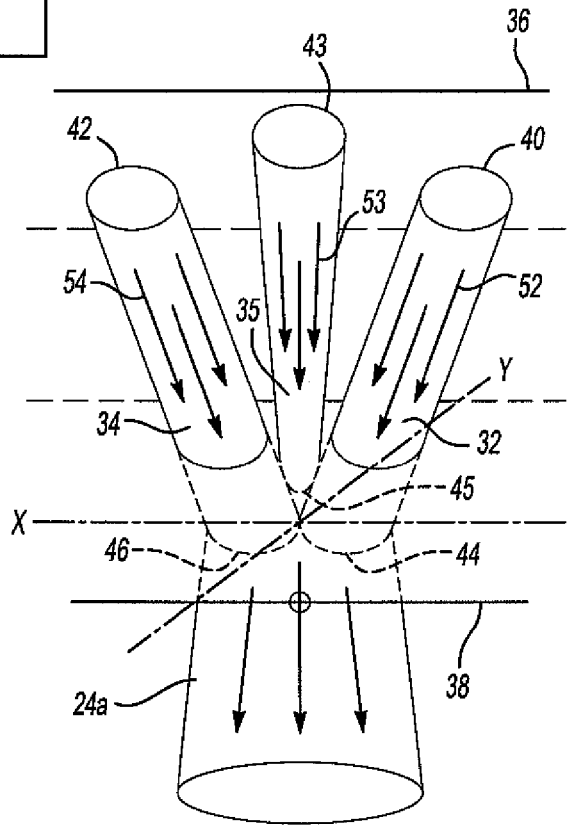
FIG. 4B is a schematic view of another example fuel flow through the example orifice disc.

Referring to FIG. 4B, the elliptical spray pattern 24 can be transformed into a circular spray pattern by the addition of a third orifice 35 that provides another impinging fuel flow 53 adjacent the first two outlets 44, 46. The third orifice 35 includes an inlet 43 and outlet 45 and is angled relative to the first orifice 32 and the second orifice 34 to direct the third fuel flow 53 to produce the desired spray pattern 24A.

Further, the inclusion of an angular component in the Y-direction 55 along with the angular component in the X-direction provide for the desired targeting of the fuel spray 24. Further, the addition of the Y-direction angular component of the orifices 32, 34 provide for the further reduction in SMD values, and thereby improvements to atomization.

Figure 5:
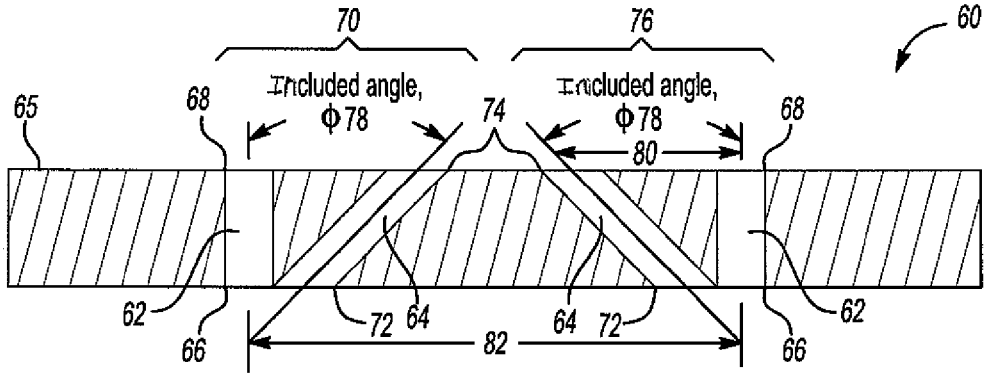
FIG. 5 is a cross-sectional view of another example orifice disc.

Referring to FIG. 5, another example orifice disc 60 includes a first couplet system 70 and a second couplet system 76. Each of the couplet systems 70, 76 includes a first orifice 62 that is disposed normal to the fuel inlet surface 65 and a second orifice 64 disposed at an angle 78 to the fuel inlet surface 65. The first orifice 62 includes a first inlet 68 that is spaced apart from a second inlet 74. Fuel entering the first inlet 68 exists a first outlet 66. Fuel entering the second orifice 64 exits through a second outlet 72. Fuel flow through the first orifice 62 is impinged by flow through the second orifice 64. The impinging flow provides the desired impacts and momentum changes that reduce the overall fuel droplet size to improve atomization.

The outlets of the first couplet system 70 are spaced a distance 82 from the second couplet system 76. The spacing of the two couplet systems 70, 76 provide for the creation of a desired spray pattern for directing fuel spray as is desired to improve combustion. The angle 78 between the first orifice 62 and the second orifice 64 is 45° in the example illustrated. The 45° angle provides velocities of fuel flow and impingement to create the reduced SMD values that are indicative of improved atomization.

Figure 6:
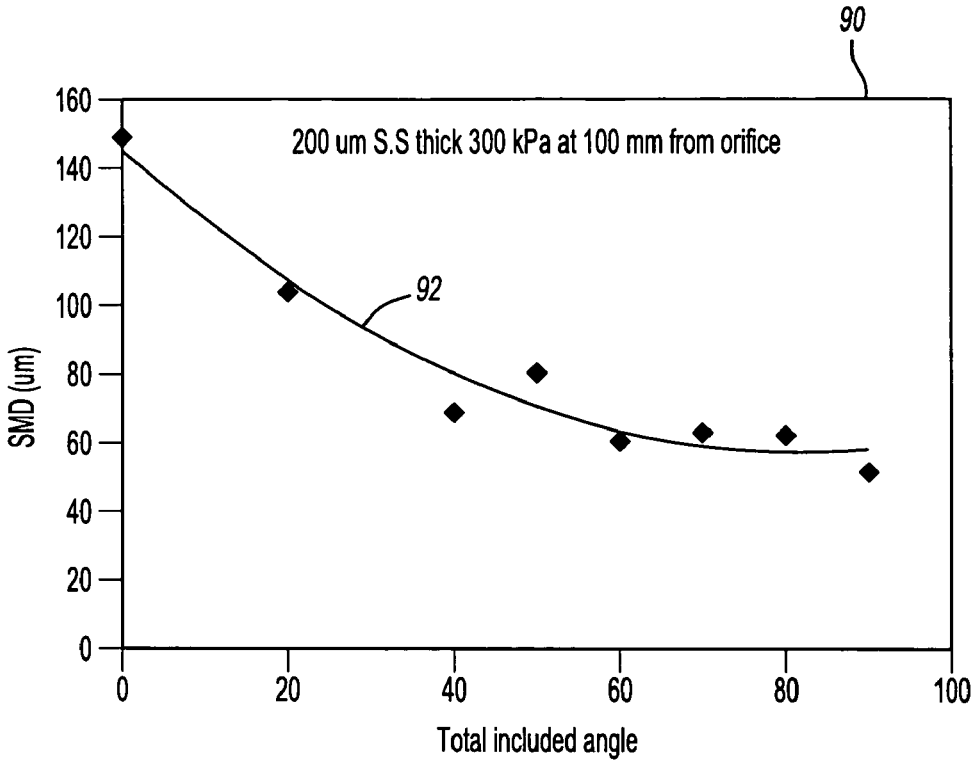
FIG. 6 is a graph illustrating an example relationship between fuel droplet size and an angle between orifices.

Referring to FIG. 6, a graph 90 illustrates an example relationship between the SMD value and the included angle. The included angle corresponds to the angle 78 illustrated in FIG. 5, and the angle 50 shown in FIG. 2. As the included angle increases toward 90° the SMD value decreases. Accordingly, the greater the angle, the lower the SMD value.

Figure 7:
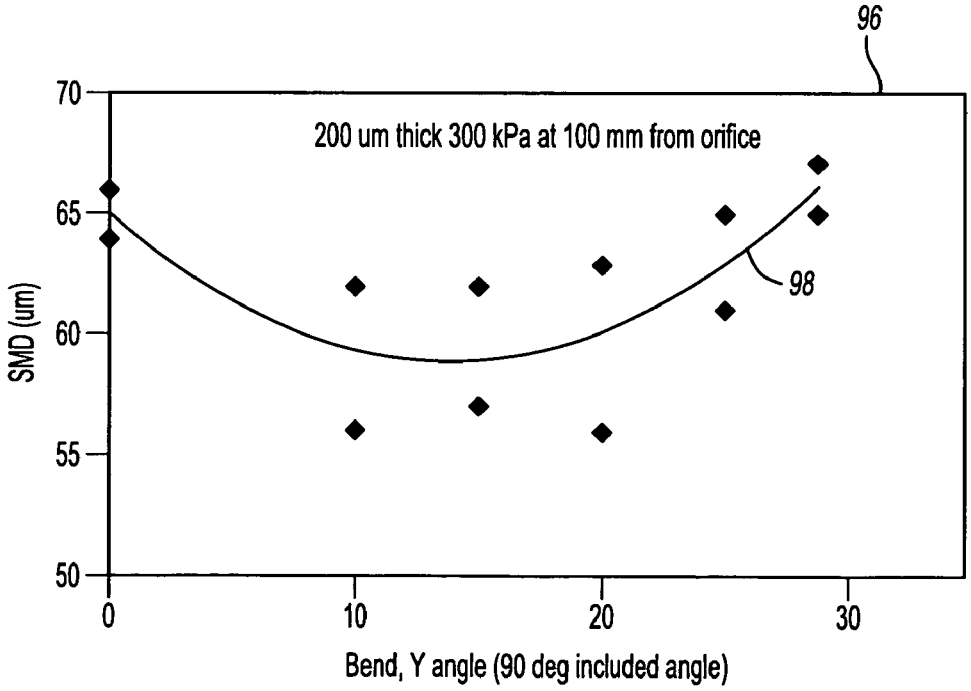
FIG. 7 is a graph illustrating an example relationship between fuel droplet size with an orifice having both an X and Y angular component.

Referring to FIG. 7, another graph 96 illustrates limits to the SMD reduction when the impinging fuel flows interact at the outlet surface of the orifice disc 22 as related to the angular Y-component 55 for each of the orifices. The angular X-component 50 is 90°. As is indicated, the SMD value is at a minimum for impingement angles between approximately 10 and 20 degrees when two fuel flows interact at the outlet surface.

Figure 8:
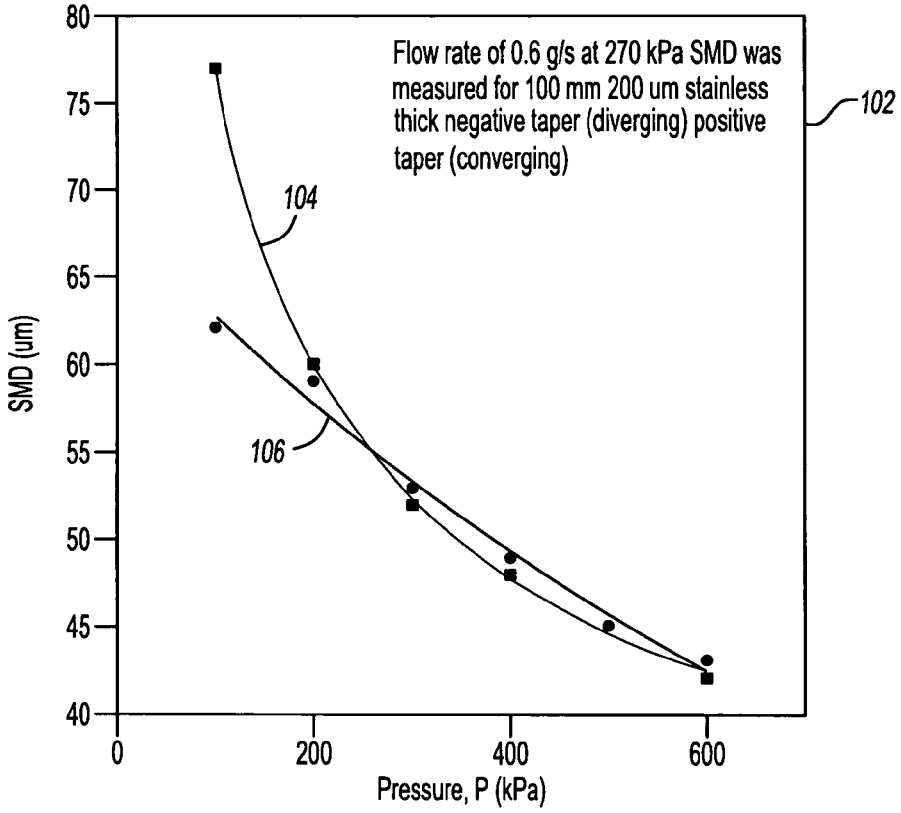
FIG. 8 is a graph illustrating an example relationship between droplet size and pressure for the example orifice disc.

Referring to FIG. 8, a graph 102 is shown and illustrates an example relationship between SMD value and the pressure of fuel provided at the fuel orifice. The graph illustrates the difference in SMD value for similar pressures with a diverging tapered couplet system indicated at 104 and a converging tapered couplet system indicated at 106. As is shown the converging tapered couplet system provides a lower SMD value at lower pressures than a similarly configured diverging orifice couplet. The converging orifice couplet includes an inlet larger than the outlet such that fuel velocity is increased and directed over a smaller area as compared to a divergent orifice. The divergent orifice includes an outlet of a larger size than the inlet, resulting in a reduction in velocity over a larger area. Further, the SMD value for larger pressures is approximately the same. The desire is to provide lower SMD without requiring a corresponding increase in pressures.

Figure 9:
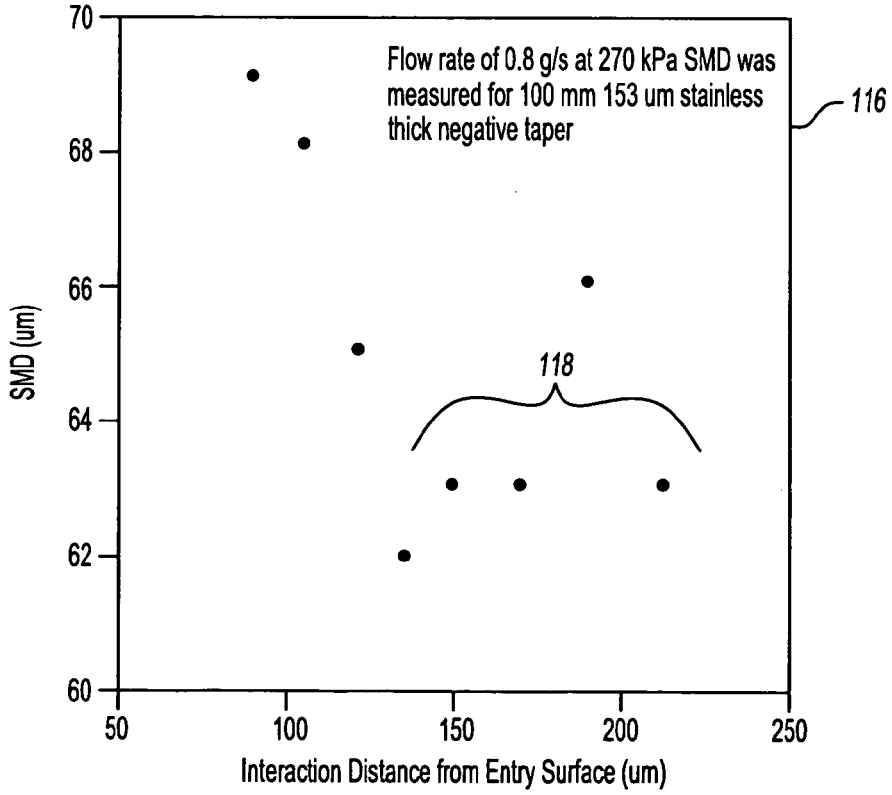
FIG. 9 is a graph illustrating an example relationship between fuel droplet size and an interaction distance from an entry surface.

Referring to FIG. 9, a graph 116 illustrates an example relationship between the SMD value and a distance from the fuel inlet surface 36 of the orifice disc 22. The interaction distance is the distance at which the fuel flows impinge on each other and provide a measure of how the fuel flows are directed by the orifices 32, 34 to reduce the fuel droplet size. The distance from the fuel inlet surface 36 indicates that some of the measured SMD values result from impingement of fuel flows within the orifice disc 22. In other words, the fuel flows impinge on each other between the fuel inlet surface 36 and the fuel outlet surface 38. As the interaction distance increases, so does fuel velocity, resulting in larger momentum changes and smaller SMD values. This is shown by the lower SMD values at the greater distances from the fuel inlet surface 36 indicated by the data points 118 generally indicated on the graph 116.

Figure 10:
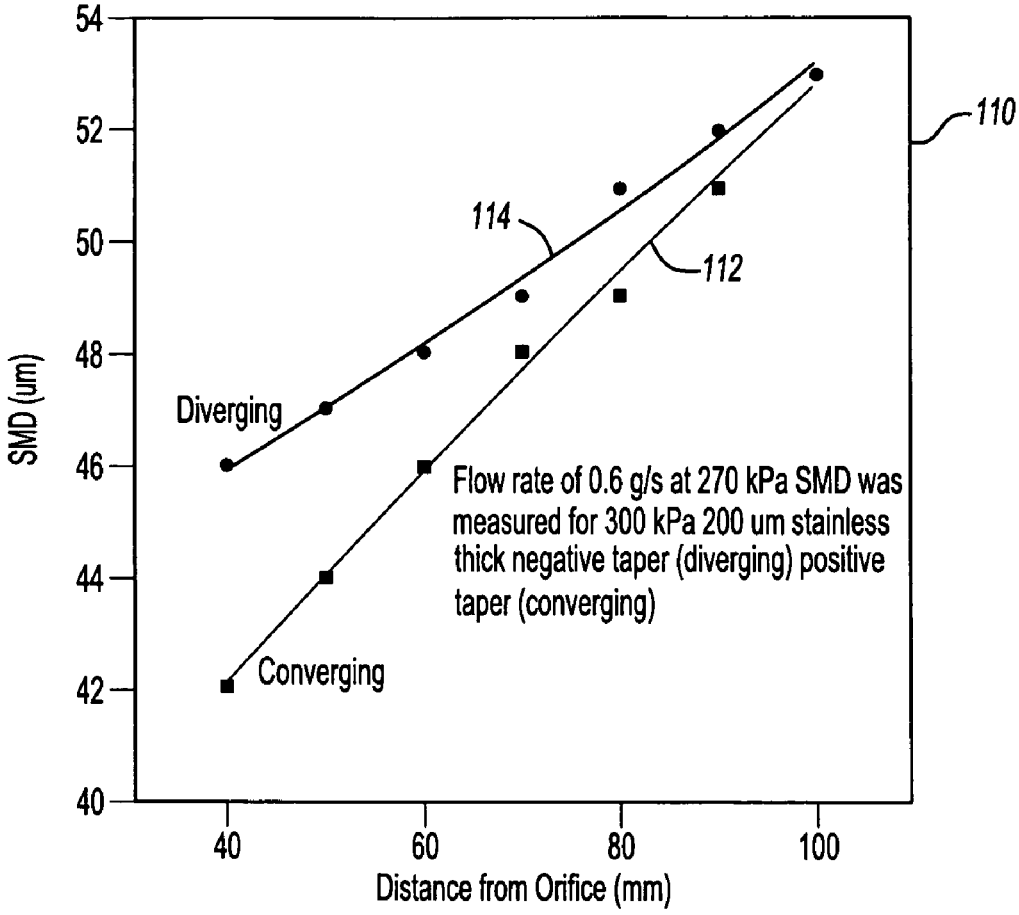
FIG. 10 is a graph illustrating an example relationship between fuel droplet size and distance from the orifice.

Referring to FIG. 10 a graph 110 illustrates an example relationship between the SMD value and a distance from the orifice outlets at which the fuel flows impinge on each other. As is shown for a converging couplet system indicated at 112, the SMD values are much lower than the similarly configured diverging couplet system as is indicated at 114. The closer to the orifice outlet and outlet surface of the orifice disc that that impingement can be induced, the better the SMD values. Further, the graph 110 illustrates the effect on SMD values as the interaction between fuel flows is moved away from the outlet surface. The overall SMD values increase and begin to merge for convergent and divergent orifice configurations with increased distance. An increased distance from the orifice surface reduces the impact that the converging orifice configuration has on the SMD values. Accordingly, the example orifice disc 22 provides for the interaction of fuel flows substantially at or before the fuel outlet surface.

The example fuel orifice discs illustrated reduce SMD values by creating large changes in momentum to disintegrate fuel droplets into smaller finer droplets that make up the fuel spray. Further, the angular orientation of the orifices 32, 34 provide for tailoring the targeting and shape of the fuel spray as desired. The decreased SMD values provide the desired improvements in atomization that in turn improve combustion.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A fuel injector assembly comprising:

an electromechanical valve for controlling the flow of fuel through the fuel injector assembly; and an orifice plate for defining a fuel spray pattern emitted by the fuel injector, the orifice plate including a pair of couplets, each of said couplets including a first orifice including a first outlet and a second orifice including a second outlet with said second outlet of said second orifice abuts said first outlet of said first orifice, wherein a first fuel flow through the first orifice impinges on a second fuel flow through the second orifice, wherein said first orifice for each of the pair of couplets is disposed normal to a fuel outlet surface of said orifice plate and disposed radially outboard of the corresponding second orifice, wherein the second orifice is disposed at an angle relative to the fuel outlet surface of said orifice plate.

2. The assembly as recited in claim 1, wherein the first outlet and the second outlet define an interaction point where the first fuel flow impinges on the second fuel flow.

3. The assembly as recited in claim 1, wherein the first orifice and the second orifice are disposed at an interaction angle relative to each other such that the first fuel flow and the second fuel flow impinge on each other thereby atomizing a quantity of fuel.

4. The assembly as recited in claim 1, wherein the first orifice is disposed normal to the fuel outlet surface and the second orifice is disposed at an angle relative to the fuel outlet surface.

5. The assembly as recited in claim 4, wherein the second orifice is disposed at an angle of substantially 45 degrees to a fuel inlet surface.

6. The assembly as recited in claim 1, wherein said first orifices of each of said pair of couplets are spaced a distance apart from each other, and said second orifices of each of said pair of couplets are disposed within said distance between said first orifices.

7. The assembly as recited in claim 1, wherein said second orifice of each of said pair of couplets is directed radially outward.

* * * * *